US007334631B2

(12) United States Patent
Kato et al.

(10) Patent No.: US 7,334,631 B2
(45) Date of Patent: Feb. 26, 2008

(54) HEAT EXCHANGER

(75) Inventors: Yasuyoshi Kato, c/o Tokyo Institute of Technology, 2-21-1 O-okayama, Meguru-ku, Tokyo (JP) 152-8550; Takao Ishizuka, Tokyo (JP); Nobuyoshi Tsuzuki, Tokyo (JP)

(73) Assignee: Yasuyoshi Kato, Tokyo (JP)

( * ) Notice: Subject to any disclaimer, the term of this patent is extended or adjusted under 35 U.S.C. 154(b) by 132 days.

(21) Appl. No.: 11/263,283

(22) Filed: Oct. 29, 2005

(65) Prior Publication Data

US 2006/0090887 A1 May 4, 2006

(30) Foreign Application Priority Data

Oct. 29, 2004 (JP) ..... 2004-316490

(51) Int. Cl.
*F28F 3/04* (2006.01)

(52) U.S. Cl. ..... 165/166; 165/170

(58) Field of Classification Search ..... 165/166, 165/168, 169, 170

See application file for complete search history.

(56) References Cited

U.S. PATENT DOCUMENTS 1,170,625 A * 2/1916 Fulton ..... 165/96
2,834,582 A * 5/1958 Kablitz ..... 165/81
5,474,832 A * 12/1995 Massey ..... 428/182
5,544,703 A * 8/1996 Joel et al. ..... 165/167
6,702,005 B1 * 3/2004 Blomgren ..... 165/166
2001/0042386 A1 * 11/2001 Allam et al. ..... 165/166
2004/0188074 A1 * 9/2004 Sabin et al. ..... 165/166

OTHER PUBLICATIONS

Ngo et al., *New Printed Circuit Heat Exchanger with S-Shaped Fins for Hot Water Supplier*. ECI International Conference on Heat Transfer and Fluid Flow in Microscale, Castelvecchio Pascoli, Sep. 25-30, 2005.

Kato et al., *New Microchannel Heat Exchanger for Carbon Dioxide Cycle*, 7th IIR Gustav Lorentzen Natural Working Fluids Conference, Aug. 30-Sep. 1, 2005, Vicenza, Italy.

Tsuzaki et al., *High Performance Printed Circuit Heat Exchanger*, Heat SET 2005, Heat Transfer in Components and Systems for Sustainable Energy Technologies, Apr. 5-7, 2005, Grenoble, France.

* cited by examiner

*Primary Examiner*—Teresa J. Walberg
(74) *Attorney, Agent, or Firm*—Intellectual Property Law Group LLP; Otto O. Lee; Juneko Jackson

(57) ABSTRACT

To reduce pressure loss on a heat-exchanger fluid while downsizing a heat exchange and reducing the production cost of the heat exchanger without impairment of the heat transfer performance of the heat exchanger by forming a fluid channel in surfaces of thin metal plates such as stainless steel plates through the use of an etching technique or the like and by improving the shape of the fluid channel. In a heat exchanger in which a plurality of heat exchanger fins are provided in thin metal plates by using an etching technique or the like and a fluid channel for a heat-exchanger fluid is formed between the two opposed thin metal plates by alternately stacking the thin metal plates, the area of the fluid channel, through which the fluid flows between the heat exchanger fins, is made substantially uniform by forming the heat exchanger fins so as to have a curved cross-sectional shape from the front end thereof to the rear end.

8 Claims, 15 Drawing Sheets

Hot side plate/Cold side plate=1
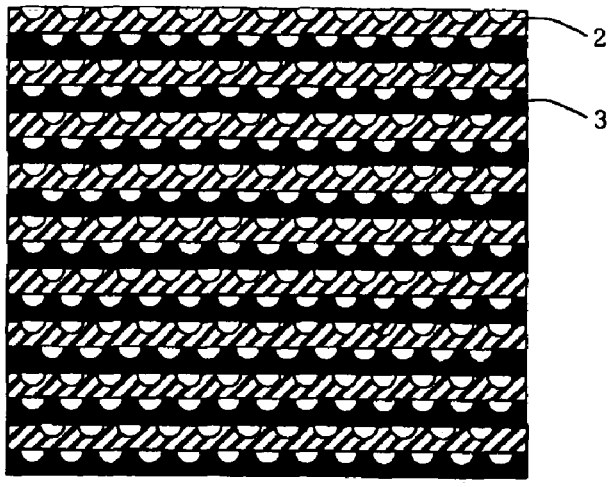
(a)
Hot side plate/Cold side plate=2
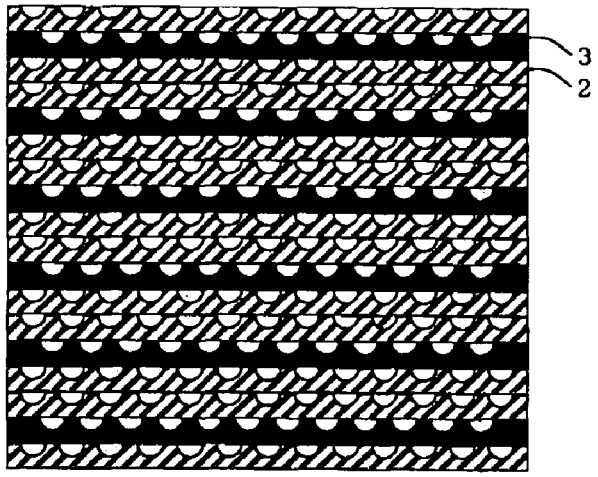
(b)
Hot side plate/Cold side plate=4
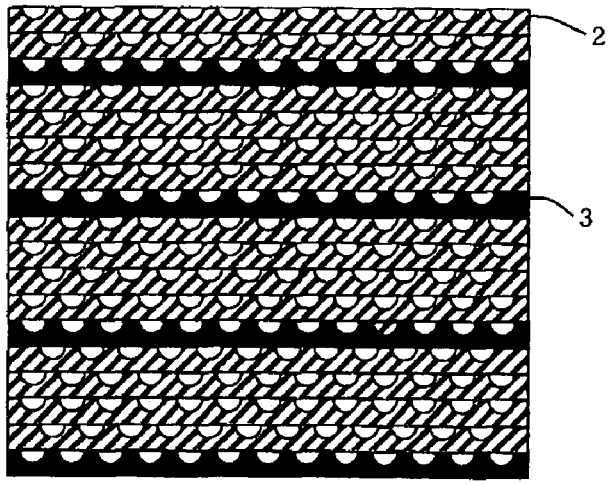
(c)
FIG. 4

| Fluid flow | | Counterflow |
|---|---|---|
| Fluid material | | $CO_2$ |
| Plate | Material | 316 Stainless steel |
| | Thickness (mm) | 1.6 |
| Fin geometry | Inclination angle (degree) | 52 |
| | Width (mm) | 0.8 |
| Flow channel geometry (mm) | Width | 1.9 |
| | Depth | 0.94 |
| Mass flux (kg/s $m^2$) | Hot side fluid | 42.1 |
| | Cold side fluid | 76.8 |
| Fluid inlet temperature (°C) | Hot side fluid | 553 |
| | Cold side fluid | 382 |
| Fluid outlet temperature (°C) | Hot side fluid | 496 |
| | Cold side fluid | 438 |
| Fluid inlet pressure (MPa) | Hot side fluid | 2.5 |
| | Cold side fluid | 7.4 |

FIG. 10

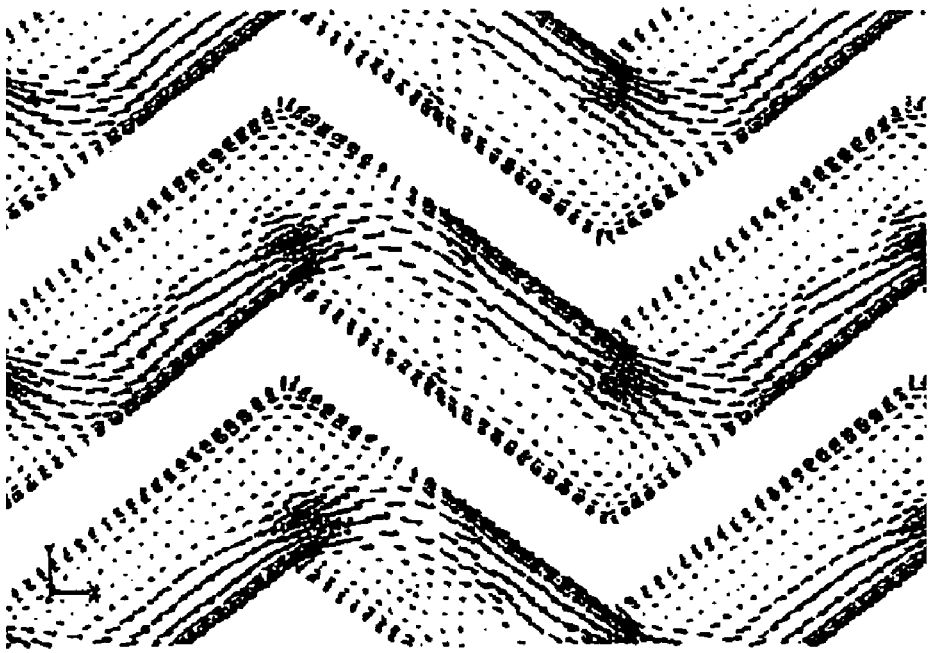
(a) Prior art zigzag flow path
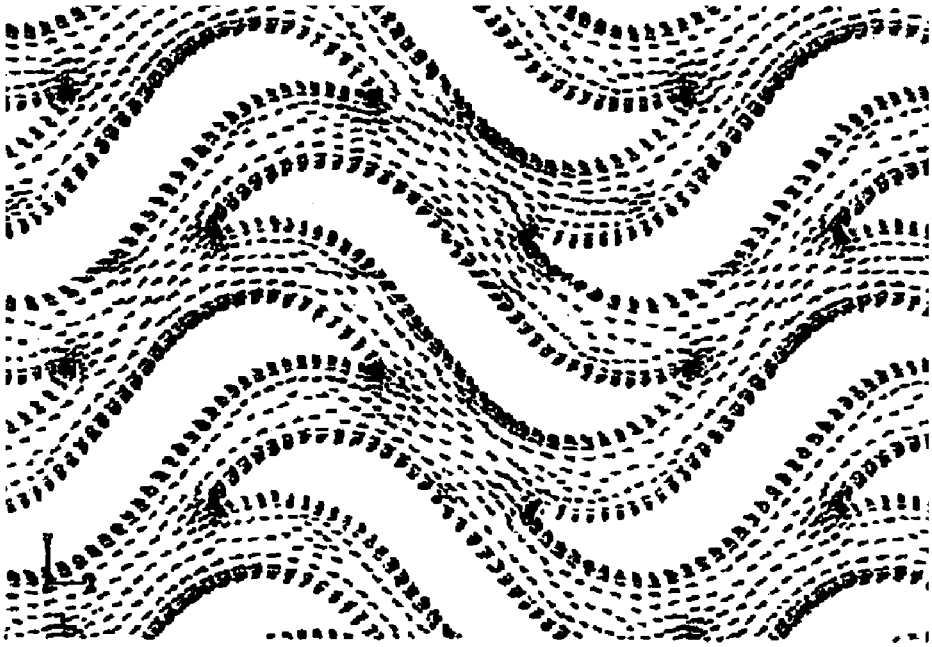
(b) Flow path with discontinous curved fin of the present investion.
FIG. 13

HEAT EXCHANGER

BACKGROUND OF THE INVENTION

1. Field of the Invention

The present invention relates to a plate-fin type heat exchanger used for transferring heat between two fluids on high- and low-temperature sides different in temperatures.

2. Description of the Prior Art

In general, heat exchangers are widely used for the utilization of heat energy, equipment requiring heat removal and so on. Among them, there is a plate-fin type heat exchanger as a typical high-performance heat exchanger. The plate-fin type heat exchanger has a structure in which thin metal plates formed by press working or the like are stacked, and then opposed, cross, or parallel fluid channels of two heat-exchanger fluids of high temperature (hot) side fluid and low temperature (cold) side fluid are formed between the thin metal plates.

Moreover, to increase heat transfer efficiency between two heat-exchanger fluids different in temperature, heat exchangers have been produced so as to increase their heat transfer areas and disrupt the flow of fluids through the provision of a plurality of heat exchanger fins to fluid channels through which heat-exchanger fluids flows as described in Japanese Published Unexamined Patent Application No. 2004-183916.

However, in those heat exchangers, there have been disadvantages in that when a plurality of thin metal plates are stacked to improve heat transfer characteristics, the volumes of the heat exchangers increase contrary to a request to downsize them and when the heat exchanger fins are attached at closer spacings by increasing the number of heat exchanger fins to be provided in the fluid channel, their pressure loss and production cost required to attach the heat exchanger fins increase despite an improvement in the heat transfer characteristics.

SUMMARY OF THE INVENTION

To solve those problems, a heat exchanger has been heretofore proposed and commercialized in which zigzag fluid channels are engraved on the surfaces of thin metal plates by using an etching technique, the thin metal plates on high- and low-temperature (hot and cold) side fluids are stacked, and the two opposed thin metal plates are joined together at their contact portion by the diffusion of metallic atoms constituting the thin metal plates to downsize the heat exchanger without impairment of the heat transfer characteristics of the heat exchanger.

FIG. 14(*a*) is a perspective view of a conventional type of heat exchanger. In such a heat exchanger 51, fluid channels, through which two heat-exchanger fluids on low-temperature (cold) sides flow are engraved on thin metal plates 52 and high-temperature (hot) sides flow are engraved on thin metal plates 53. The thin metal plates 52 and 53 are alternately joined together face to face as a layer to conduct heat exchange between the two heat-exchanger fluids on high- and low-temperature sides via the thin metal plates. To increase a heat transfer area, fluid channels 54*a* and 54*b* meandering in a zigzag condition are engraved on the thin metal plates 52 and 53 respectively as shown in FIG. 14(*b*). Inlet and outlet openings for the heat-exchanger fluids on the low-temperature (cold) and high-temperature (hot) sides are connected to pipe arrangements (not shown). To avoid interference between the pipe arrangements, as shown in FIG. 14(*a*), the fluid channels 54*a* on the low-temperature (cold) side are straight through the inlet and outlet openings of the thin plate metals 52 and the fluid channels 54*b* on the high-temperature (hot) side are bent into a 90° angle near the inlet and outlet openings of the thin plate metals 53 and orientations of the inlet and outlet portions on the low-temperature (cold) side fluids and high-temperature (hot) side fluids are square to each other.

However, in the heat exchanger 51, since the fluid channels 54 (54*a*, 54*b*) meander in a zigzag condition as shown in FIG. 14(*b*), vortexes flows F1 and swirl flows F2 are formed at the downstream portions of the bent portions 55 of the fluid channels 54 as shown in FIG. 15, which results in energy loss. Because of this, there has been a disadvantage in that increased pressure losses of the fluid channels 54 result in an increased pump power and hence, equipment costs and operating costs increase.

Therefore, an object of the invention is to lower pressure loss on a heat-exchanger fluid while downsizing the heat exchanger and reducing the production cost thereof without impairment of the heat transfer performance of the heat exchanger by forming a fluid channel in the surfaces of thin metal plates such as stainless steel plates using an etching technique or the like and by improving the shape of the fluid channel.

The foregoing object of the present invention is attained by providing a heat exchanger comprising: a plurality of heat exchanger fins which are formed on thin metal plates and which have a curved cross-sectional shape from one end thereof to the other; and fluid channels for high-temperature and low-temperature fluids which are formed between the two adjacent heat exchanger fins of the two opposed thin metal plates by alternately stacking the thin metal plates having the heat exchanger fins and which have fluid channel areas which are substantially uniform at any place in the flow direction of the fluids.

The object is attained by forming the heat exchanger fins so as to have a substantially S-shaped curved cross-sectional shape. Moreover, the object is effectively attained by providing the heat exchanger having the heat exchanger fins whose cross-sectional shape is formed by a curve forming part of a circle, an ellipse, a parabola, or a hyperbola, or a combination of those curves.

The object is effectively attained by providing the heat exchanger having a structure in which the front and rear ends of the heat exchanger fins are streamlined in the flow direction of a fluid and the cross-sectional shape of the fins are formed by a substantially S-shaped curve, a curve forming part of a circle, an ellipse, a parabola, or a hyperbola, or a combination of those curves from the front ends to the rear ends to make the fluid channel area of the channel, where a fluid flows between the two adjacent heat exchanger fins, substantially uniform at any place in the flow direction.

The object is effectively attained by providing the heat exchanger having a structure in which fin rows consisting of the plurality of heat exchanger fins are formed and the plurality of fin rows are formed in the flow direction of a fluid by arranging the heat exchanger fins in a direction perpendicular to the flow direction of the fluid to make the fluid channel area of the channel, where the fluid flows between the two adjacent heat exchanger fins, substantially uniform at any place in the flow direction.

The object is effectively attained by providing the heat exchanger having a structure in which the heat exchanger fins are staggered in the flow direction of a fluid and the rear ends of the heat exchanger fins of the fin rows on the upstream sides in the flow direction of the flow are provided at midpoint positions between the adjacent heat exchanger fins of the fin rows on the downstream sides.

The object is effectively attained by providing the heat exchanger having a structure in which the streamline of a heat-exchanger fluid is formed in a curve along the heat exchanger fins by forming the heat exchanger fins having a curved cross-sectional shape from the inlet side to the outlet side of the heat-exchanger fluid.

The object is effectively attained by providing the heat exchanger having a structure in which the streamline of a fluid is formed in a sine curve or a pseudo sine curve formed by altering the waveform of the sine curve along the heat exchanger fins by forming the heat exchanger fins having a substantially S-shaped cross-sectional shape which is formed by a sine curve or a pseudo sine curve formed by altering the waveform of the sine curve. Moreover, the object is effectively attained by providing the heat exchanger having a structure in which the heat exchanger fins, which have a cross-sectional shape formed by a curve forming part of a circle, an ellipse, a parabola, or a hyperbola, or a combination of those curves, are formed to form the streamline of a fluid in the curve forming the part of the circle, the ellipse, the parabola, or the hyperbola, or a combination of those curves along the heat exchanger fins.

The object is effectively attained by providing the heat exchanger having a structure in which the heat exchanger fins are formed so as to have a cross-sectional shape formed by a sine curve or a pseudo sine curve formed by altering the waveform of the sine curve which continues along the flow direction of a fluid. Moreover, the object is effectively attained by providing the heat exchanger having a structure in which the heat exchanger fins are formed so as to have a cross-sectional shape formed by a curve forming part of a circle, an ellipse, a parabola, or a hyperbola, or a combination of those curves which continues along the flow direction of a fluid.

The object is effectively attained by providing the heat exchanger having a structure in which heat exchanger fins, which have a curved cross-sectional shape from their front end to their rear end along the flow direction of a fluid, are applied to the plate fins of a plate-fin type heat exchanger and the cross-sectional shapes are changed from zigzag shapes into curved shapes to make the area of a fluid channel, through which the fluid flows between the two adjacent heat exchanger fins, substantially uniform at any place in the flow direction.

As described above, in the heat exchanger according to the present invention, the heat exchanger fins are formed so as to have a cross-sectional shape formed by a curve such as an S-shaped curve, that is, a cross-sectional shape formed by a pseudo sine curve or the like and the area of the fluid channel, through which a fluid flows between the two adjacent heat exchanger fins, are made substantially uniform at any place in the flow direction of the fluid. As a result, a variation in the fluid channel area decreases, so that it is possible to reduce pressure loss resulting from the contracted and expanded flows of a heat-exchanger fluid flowing through the fluid channel; that is, it is possible to lower pressure loss on a heat-exchanger fluid while maintaining the downsizing of a heat exchanger and its reduced production cost without impairment of its heat transfer performance. Therefore, in the heat exchanger according to the invention, pressure loss can be significantly reduced to about one-sixth of those conventional heat exchangers having the same heat transfer characteristics without impairment of the heat transfer of the heat exchanger, thereby pump power can be lowered by an extent corresponding to its reduction.

BRIEF DESCRIPTION OF THE DRAWINGS

FIG. 4 is a cross-section view for explaining stacked high temperature (hot) side fluid plate and low temperature (cold) side fluid plate where the ratios of fluid flows on hot side fluid plate and cold side fluid plate differ.

FIG. 10 is a table for listing flow conditions of fluids, materials for thin metal plates, data on fluid channels, and so on included in comparative conditions of the heat transfer flow performance of heat exchangers based on a comparative experiment on the performance of the heat exchangers according to the invention and the conventional heat exchangers;

FIGS. 13(*a*) and 13(*b*) are drawings for explaining states in which the fluids flows based on the comparative experiment results conducted under the conditions indicated in FIGS. 10 and 11. FIG. 13(*a*) is a drawing of a fluid channel formed by conventional zigzag fins and FIG. 13(*b*) is a drawing of a fluid channel formed by substantially S-shaped discontinuous curved fins according to the invention;

FIG. 14(*b*) is a enlarged perspective view of the zigzag flow channels of the heat exchanger shown in FIG. 14(*a*)

DESCRIPTION OF THE PREFERRED EMBODIMENTS

An embodiment of the invention will be explained below with reference to drawings.

Figure 1:
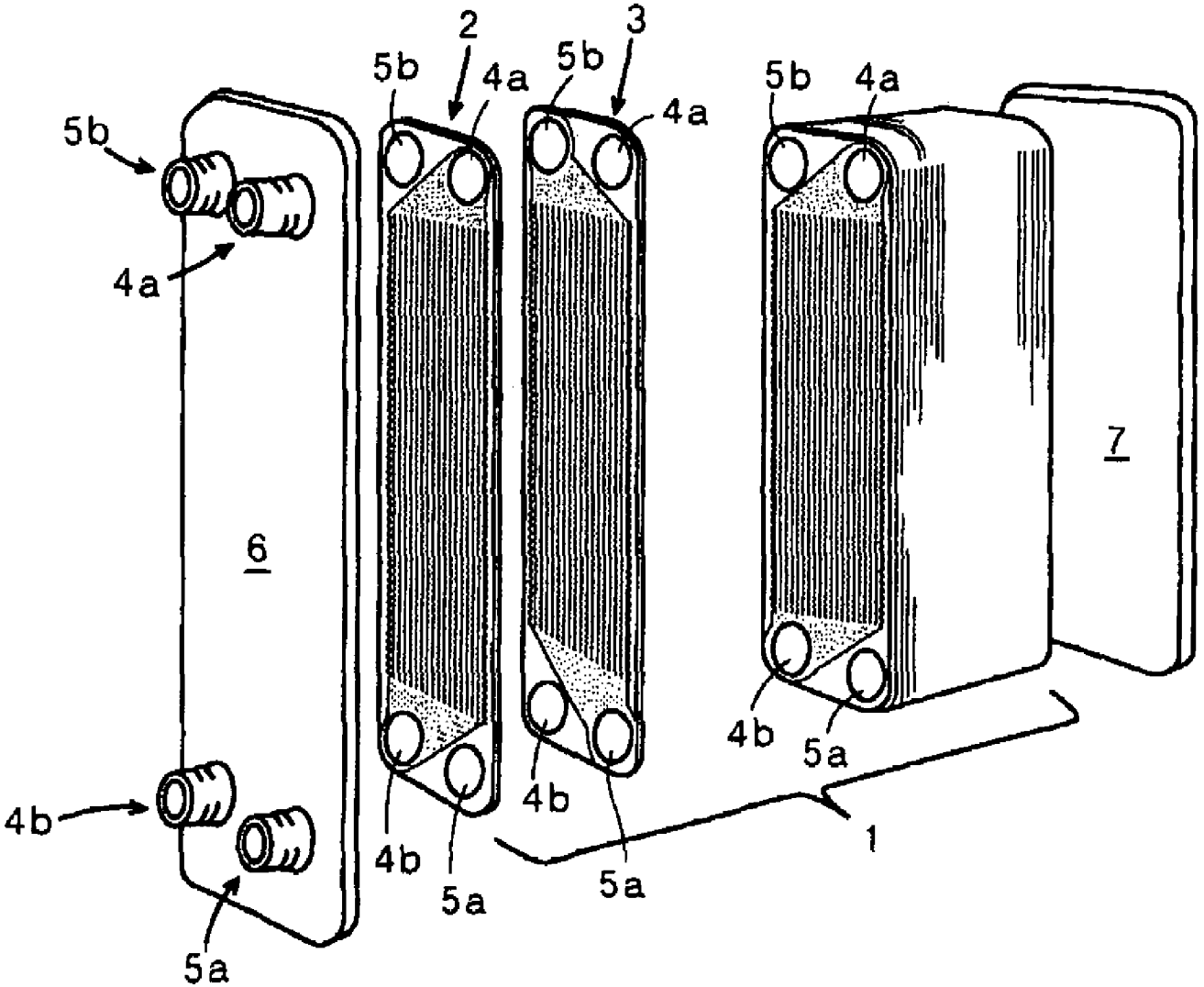
FIG. 1 is a perspective view of a heat exchanger according to the present invention and stacked thin metal plates thereof.

FIG. 1 is a schematic diagram of the appearance of a heat exchanger according to the invention. In FIG. 1, thin metal plates 2, through which a high-temperature (hot) side fluid flows, and thin metal plates 3, through which a low-temperature (cold) side fluid flows, are stacked. Plates 6 are attached to the uppermost surfaces of the metal plates 2 and 3 and bottom plates 7 are attached to the lowermost surfaces of the metal plates 2 and 3 to form a box-shaped heat exchanger body 1.

The thin metal plates 2 and 3, which constitute the heat exchanger body 1, are made of an about a several mm thick stainless steel plate, a copper plate, a titanium plate, or the like. In addition, the thin metal plates 2 and 3 are firmly joined together by using compression bonding at a temperature close to their melting points or any other method in such a way that metallic atoms, which constitute the thin plates, mutually diffuse at the contact surfaces thereof.

Figure 2:
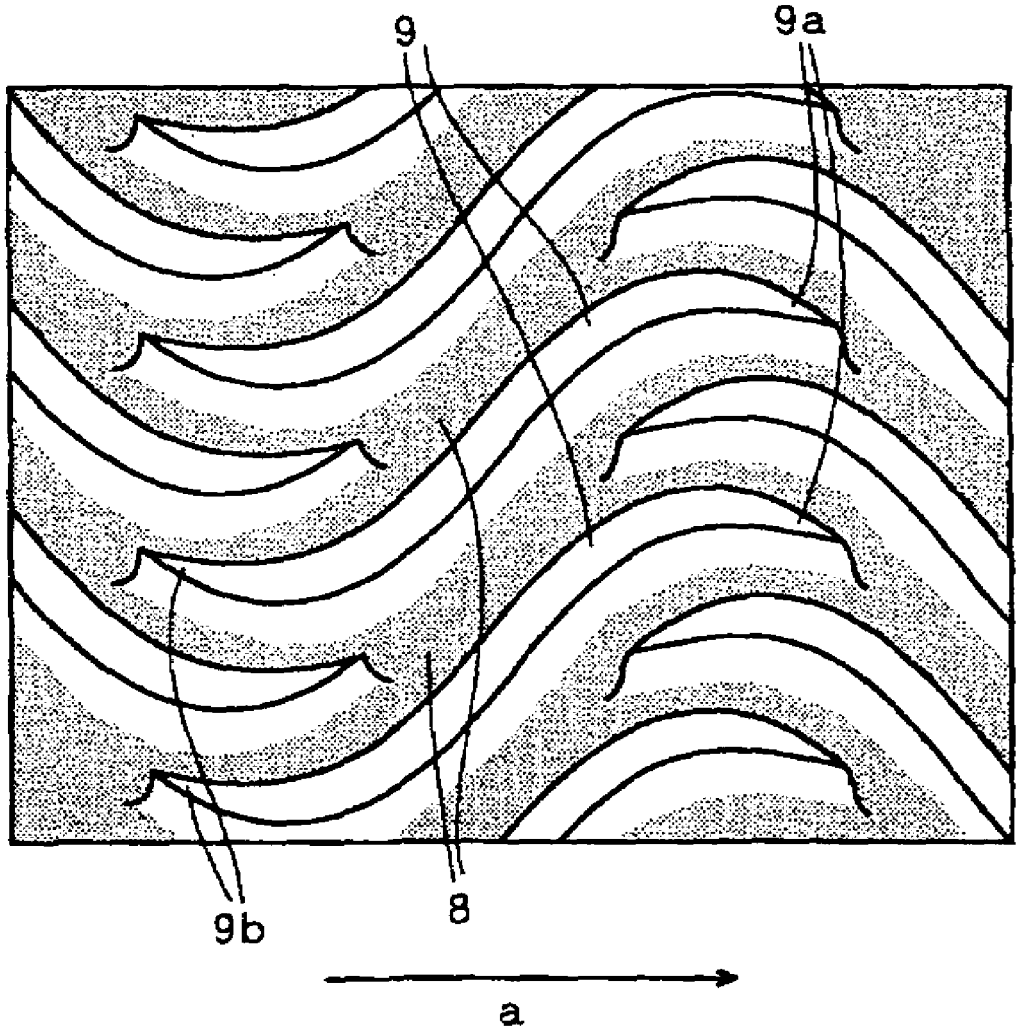
FIG. 2 is a perspective view of drawing for substantially S-shaped fins engraved on the thin metal plates within the heat exchanger and a fluid channel formed by fin rows consisting of the fins.
Figure 3:
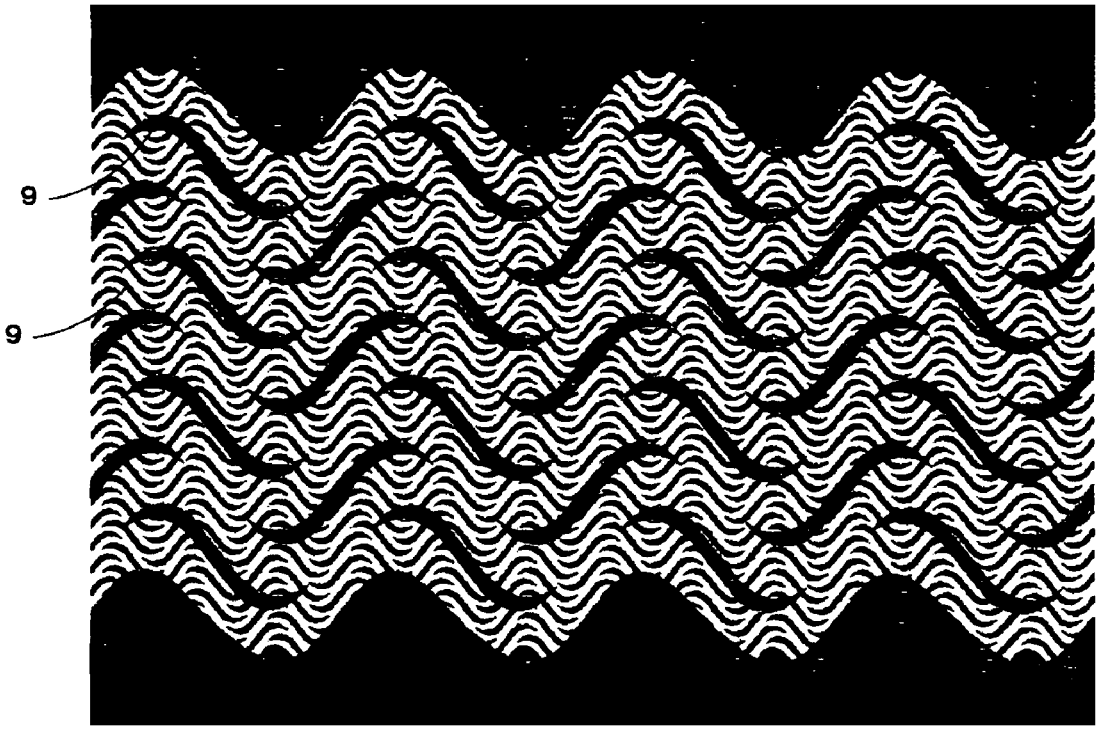
FIG. 3 is a perspective pain view of the shape and arrangement of the heat exchanger fins of the two stacked thin metal plates used for explaining a case where the heat exchanger fins between the two opposed thin metal plates are different from each other in shape.

As shown in FIG. 2, the surfaces of the thin metal plates 2 and 3 are engraved by using an etching technique to form a groove 8, thereby heat exchanger fins 9 are left. When the thin metal plates 2 and 3 are stacked, a fluid channel resulting from the groove 8 is formed between the two opposed plates. Moreover, the heat exchanger fins 9 have a substantially S-shaped cross section whose perimeter is divided by about one-fourth of a cycle from its front end 9*a* to its rear end 9*b* by using a sine curve or its altered curve (hereinafter referred to as "pseudo sine curve") and are arranged in large numbers along the main flow direction (shown by arrow (a) in FIG. 2) of the heat-exchanger fluid at a constant spacing apart. By forming such cross-sectional shapes and streamlining the front ends 9*a* and the rear ends 9*b*, turbulence such as a vortex and swirl flow does not occur at the bent portions of the fluid channels, thereby the fluid resistance of the heat exchanger fins 9 can be minimized. In addition, the cross-sectional shape of the heat exchanger fin 9 is not limited to such a shape and therefore, the cross-sectional shape thereof may be formed by a curve which forms part of a circle, an ellipse, a parabola, a hyperbola, or the like or by any combination of those curves. In addition, the shapes of the fins 9 formed in the surfaces of the thin metal plates 2 and 3 are optimally determined by the heat transfer characteristics of the fluid, the permissible pressure loss thereof, and so on. When the thin metal plates 2 and 3 are stacked, the shapes of the fins 9 are different from those of conventional fins as shown in FIG. 3.

When the said thin metal plates 2 and 3 are alternately stacked as shown in FIG. 1, all of the high-temperature fluid inlet tubes 4*a* and all of the high-temperature fluid outlet tubes 4*b* provided in the plates 2 and 3 are bonded, and furthermore all of the low-temperature fluid inlet tubes 5*a* and all of the low-temperature fluid outlet tubes 5*b* provided in the plates 2 and 3 are bonded, and thereby the fluid channels which combine whole inlet tubes 4*a* and outlet tubes 4*b* through whole hot side fluid channels on whole hot side fluid plate 2 are formed and whole inlet tubes 5*a* and outlet tubes 5*b* through whole cold side fluid channels on whole cold side fluid plates 3 are formed.

However, the high-temperature (hot) fluid doesn't flow into the low-temperature (cold) side fluid inlet tubes 5*a* and outlet tubes 5*b* provided in the respective plates 2. Similarly, the low-temperature (cold) side fluid doesn't flow into the high-temperature (hot) side fluid inlet tubes 4*a* and outlet tubes 4*b* provided in the respective plates 3.

Two kinds of fluid channels are formed respectively, wherein the high-temperature (hot) side fluid which is introduced into from the inlet tubes 4*a* of the respective hot side fluid plates 2 (the thin metal plates 2), flows out of the outlet tubes 4*b* through the fluid channel between the fins 9 on the hot side fluid plates 2, and the low-temperature (cold) side fluid which is introduced into from the inlet tubes 5*a* of the respective cold side fluid plates 3 (the thin metal plates 3), flows out of the outlet tubes 5*b* through the cold side fluid channel between the fins 9 on the cold side fluid plates 3.

Therefore, the high-temperature (hot) side fluid which is introduced from the high-temperature fluid inlet tubes 4*a* of the top plates 6 into all plates 2 by a pump (not shown), flows down from the inlet tubes 4*a* of the respective plates in the high-temperature (hot) side fluid channel partitioned with the fins 9 of respective plates 2, and then flows out of the outlet tubes 4*b* of respective plates 2 and then the outlet tubes 4*b* of the top plates 6. And the low-temperature (cold) side fluid which is introduced from the low-temperature fluid inlet tubes 5*a* of the top plates 6 into all plates 3 by a pump (not shown), flows up in the low-temperature fluid channel partitioned with the fins 9 of the respective plates 3, and then flows out of the outlet tubes 5*b* and then the outlet tubes 5*b* of the top plates 6. During traveling the fluid channel, two kinds of different temperature flows conduct heat exchange between the thin metal plates 2 and 3.

FIG. 3 is a perspective plane view where two layers of the thin metal plates 2 and 3 are stacked, and each size of the fluid channels formed between fins 9 is determined by the flow ratio of the high-temperature fluid and the low-temperature fluid.

Moreover, when one fluid flow is excessive compared with the other fluid flow, as shown in FIG. 4, it is preferable that two or more thin metal plates 2 or 3 for the fluid of excessive fluid flow are adjacent to each other and stacked.

For example, FIG. 4(*a*) shows a cross-section view of stacking two kinds of plates 2,3, where the ratio of fluid flows on hot side fluid metal plate 2 and cold side fluid metal plate 3(Hot side plate/Cold side plate=1) is equal. FIG. 4(*b*) shows a cross-section view of laminating the two kinds of plates, where the fluid flow on hot side fluid metal plate 2 is twice as much as one on cold side fluid metal plate 3 (Hot side plate/Cold side plate=2). FIG. 4(*c*) shows a cross-section view of laminating the two kinds of plates, where the fluid flow on hot side fluid metal plate 2 is four times as much as one on cold side fluid metal plate 3 (Hot side plate/Cold side plate=4).

Figure 5:
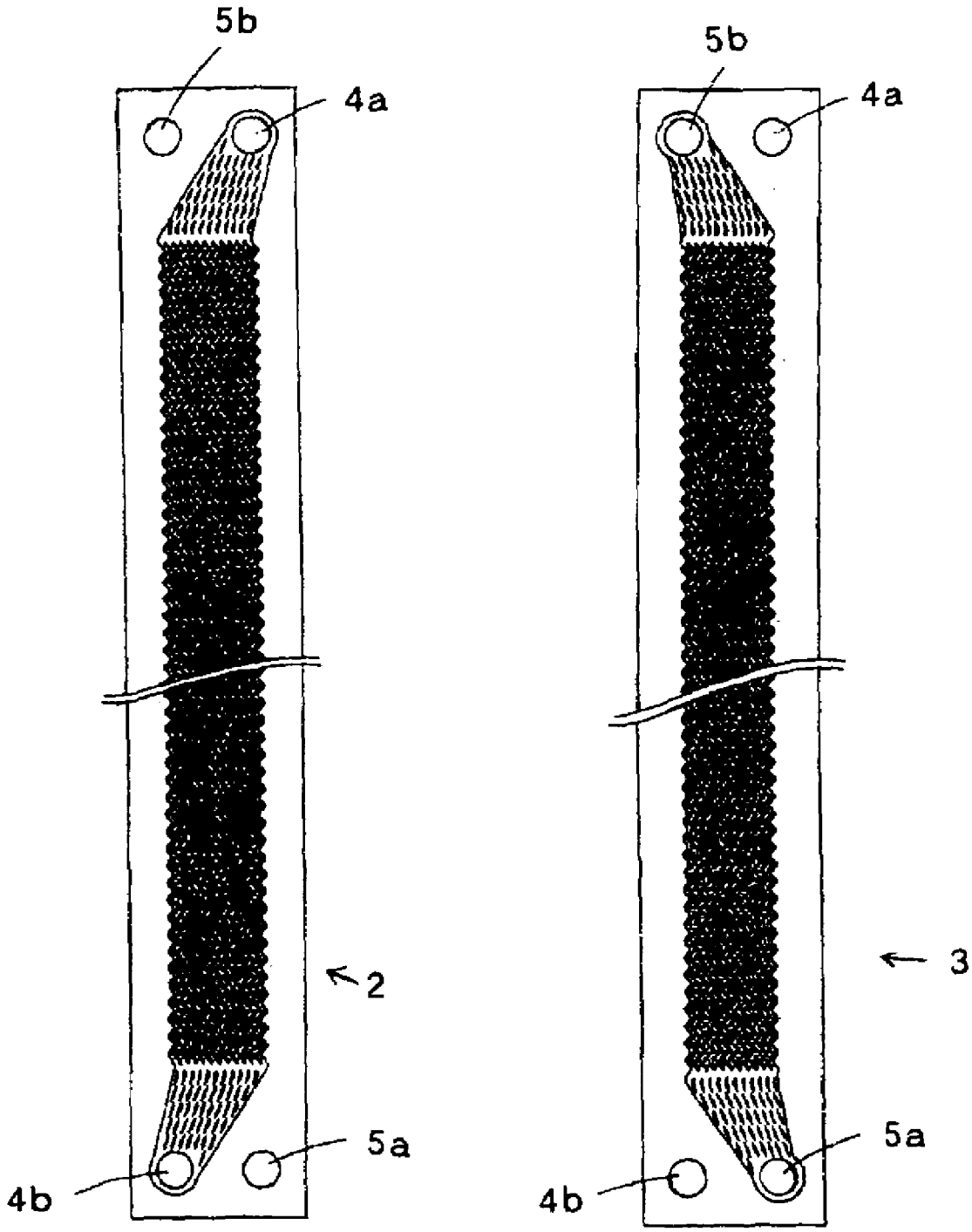
FIG. 5 is a plane view of showing thin metal plates having straight fluid channels formed between the fins.
Figure 6:
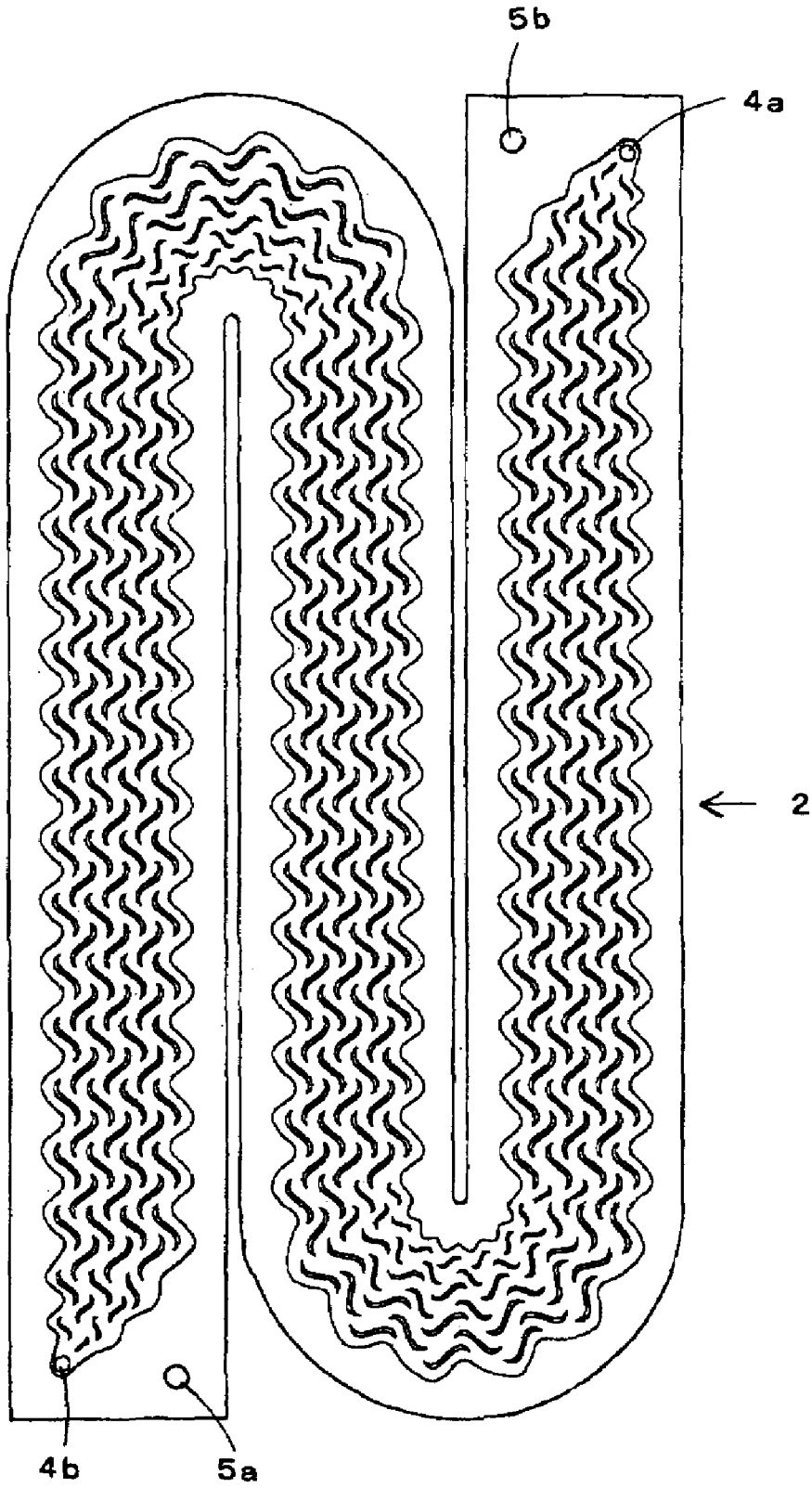
FIG. 6 is a plane view of showing thin metal plates having folding-shape fluid channels formed between the fins.

In addition, FIG. 5 shows a plane view of the thin metal plates 2 and 3 having straight fluid channels formed between the fins 9. When the length of the straight fluid channels is too long for use, the thin metal plates 2 and 3 having folding-shape fluid channels formed between the fins 9 as shown in a plane view of FIG. 6.

Figure 7:
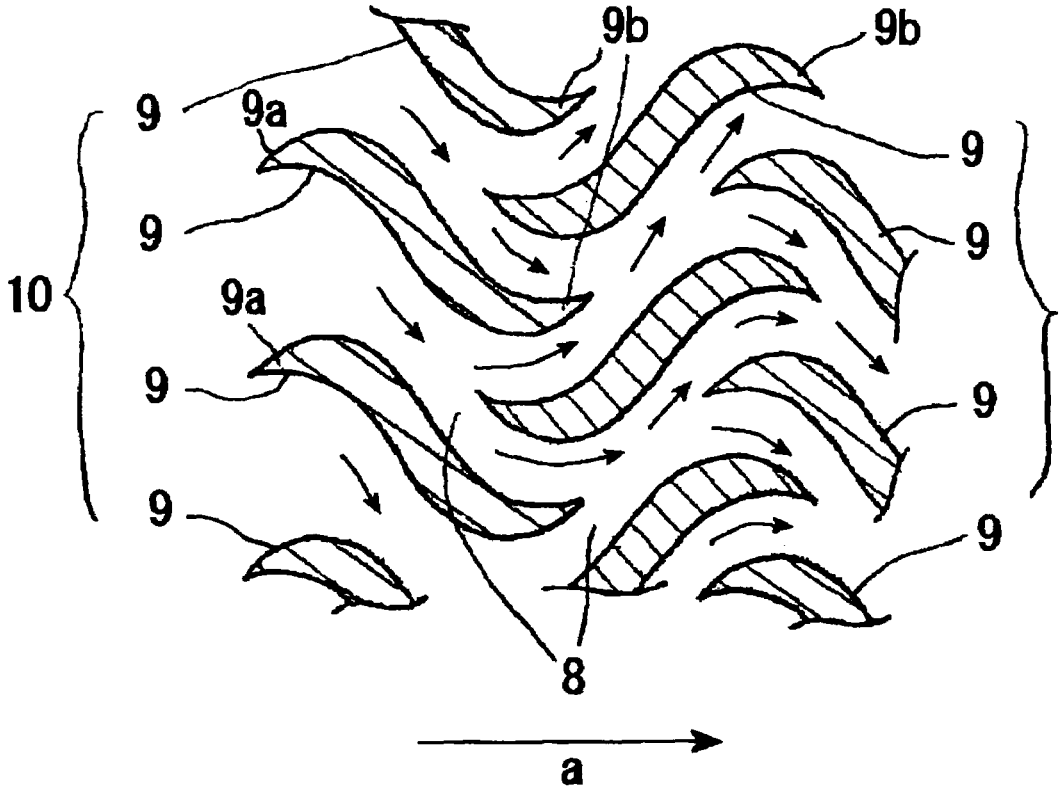
FIG. 7 is a plain view of the thin metal plate for explaining the arrangement of the heat exchanger fins.

Moreover, the heat exchanger fins 9 are arranged parallel to one another in a direction (a vertical direction in FIG. 7) vertical to the flow direction of the fluid (a lateral direction in FIG. 7) at a constant spacing apart and fin rows 10 are formed in the vertical direction. The fin rows 10 are arranged along the main flow direction (a rightward direction shown by an arrow (a) in FIG. 7) at a constant spacing apart. The plurality of fin rows 10 are formed along the main flow direction and the fin rows 10 on the downstream sides are arranged in such a way that the phases and positions of the curves such as the pseudo sine curves of the heat exchanger fins 9 deviate from those of the heat exchanger fins 9 of the fin rows 10 on the upstream sides by a predetermined spacing. That is, the heat exchanger fins 9 are staggered in the surfaces of the thin metal plates 7.

Figure 8:
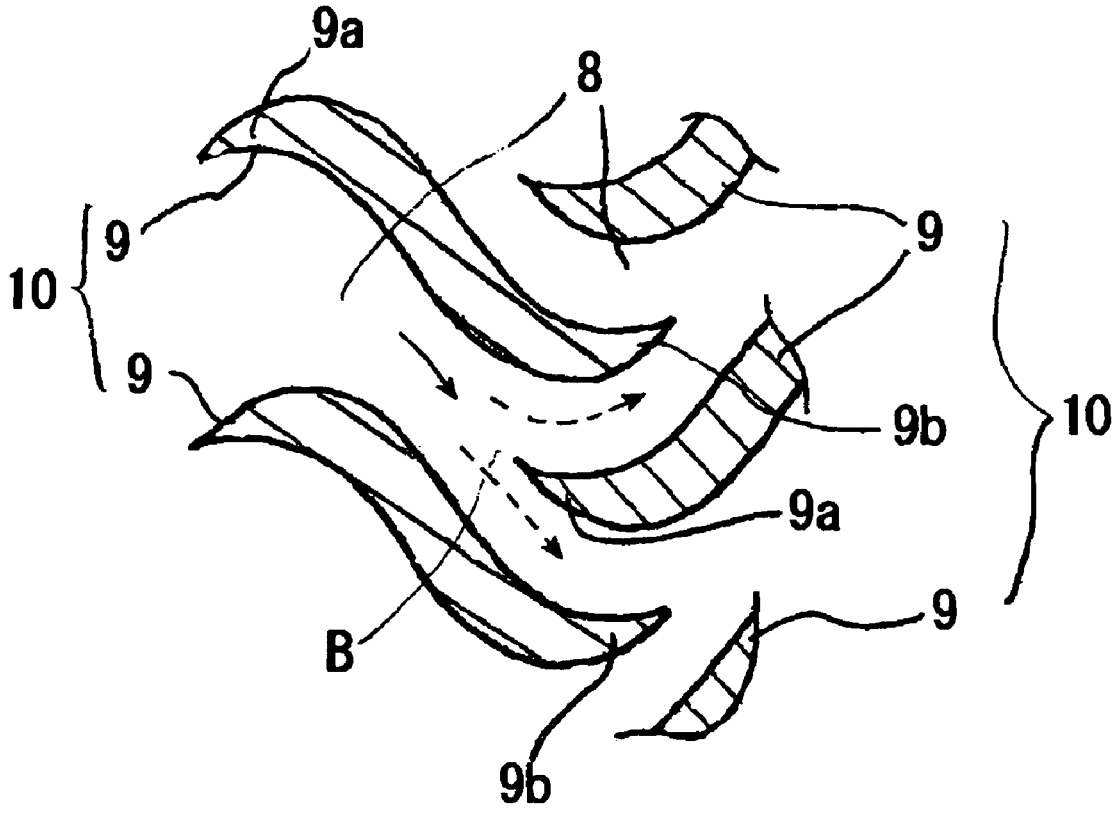
FIG. 8 is a plain view of the thin metal plate for explaining the flow of a heat-exchanger fluid around the heat exchanger fins.

As shown in FIG. 8, the arrangement of the heat exchanger fins 9 is made in such a way that the rear ends of the heat exchanger fins 9 of the fin rows 10 on the upstream sides (the left sides in FIG. 8) in the flow direction of the fluid are located at centers between the adjacent heat exchanger fins 9, 9 of the fin rows 10 on the downstream sides (the right sides in FIG. 8); that is the front ends of the heat exchanger fins 9 on the downstream sides are located at the central positions B of the respective fluid channels formed by the heat exchanger fins 9 on the upstream sides. As a result, the heat-exchanger fluid flows between the adjacent heat exchanger fins 9,9 along a direction indicated by an arrow of FIG. 8 and branches in two directions at the central position B of the fluid channel, i.e., the front end 9*a* of the heat exchanger fins 9 of the next fin row 10, thereby a structure is obtained in which the fluid channel areas of the fluid are substantially uniform even at any place between the next heat exchanger fins 9 in the flow direction of the fluid.

Figure 15:
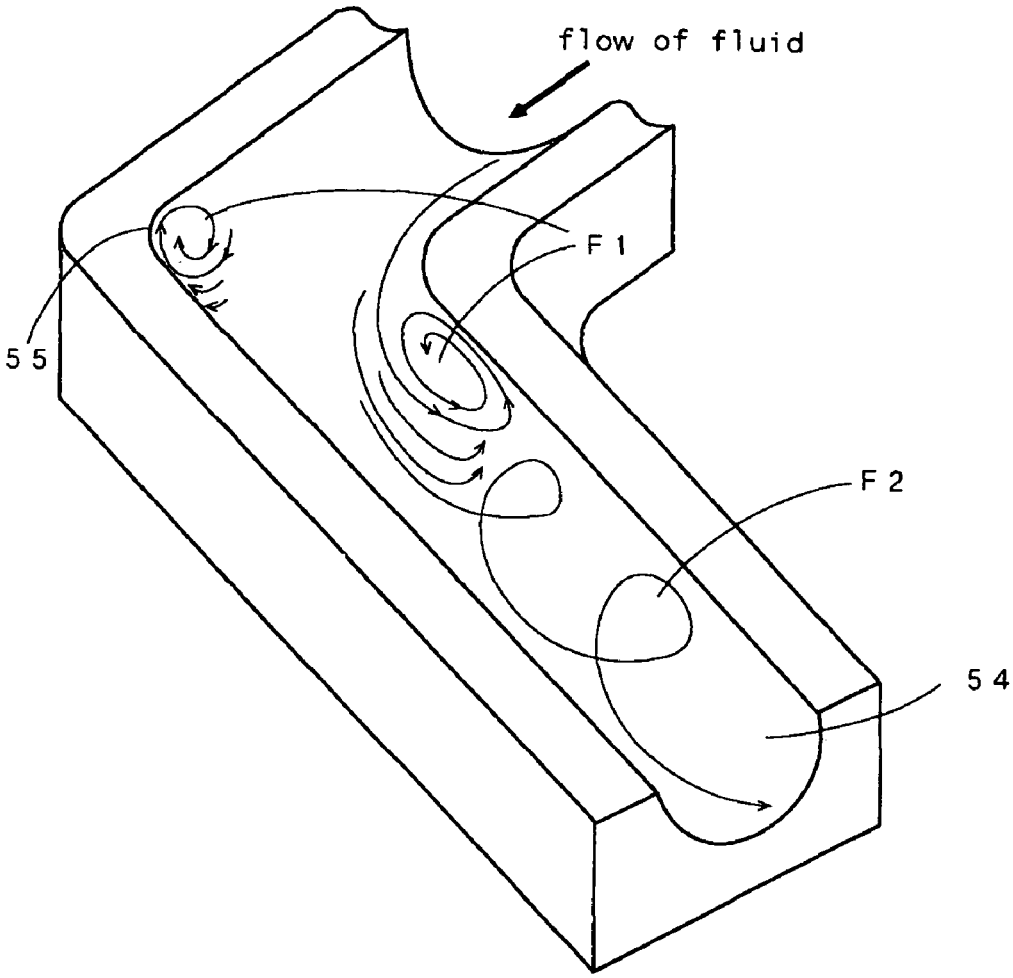
FIG. 15 is a drawing for explaining zigzag fluid flow channels formed within conventional thin metal plates where vortexes and swirl flows develop due to considerable fluid changes in directions of the fluids flow channels.

As a consequence, the front end 9*a* and rear end 9*b* of the heat exchanger fin 9 are streamlined so as not to develop vortexes and so on, which makes it possible to minimize a problem that occurs at bent portions and of conventional zigzag fluid channels, that is, pressure loss resulting from the development of vortexes flows F1 and swirl flows F2 as shown in FIG. 15 caused at sharply bent fluid channels. Therefore, a change in the fluid channel area, i.e., the expansion and reduction of the fluid channel can be eliminated and pressure loss resulting from the expanded and contracted flows of the fluid can be decreased.

Additionally, it is preferable that the thin metal plate 7 is made of a metal having excellent thermal conductivity and therefore, it is possible to select various metals such as stainless steel, iron, copper, aluminum, an aluminum alloy, and titanium.

As described above, in the heat exchanger according to the embodiment of the invention, since the heat transfer area is increased by using the plurality of heat exchanger fins 9 formed on the surfaces of the thin metal plate 7 and the heat-exchanger fluid flows along the plurality of grooves 8 without developing the pressure loss resulting from the vortexes, the swirl flows, and so on, heat exchange can be conducted effectively while lowering fluid resistance.

Figure 9:
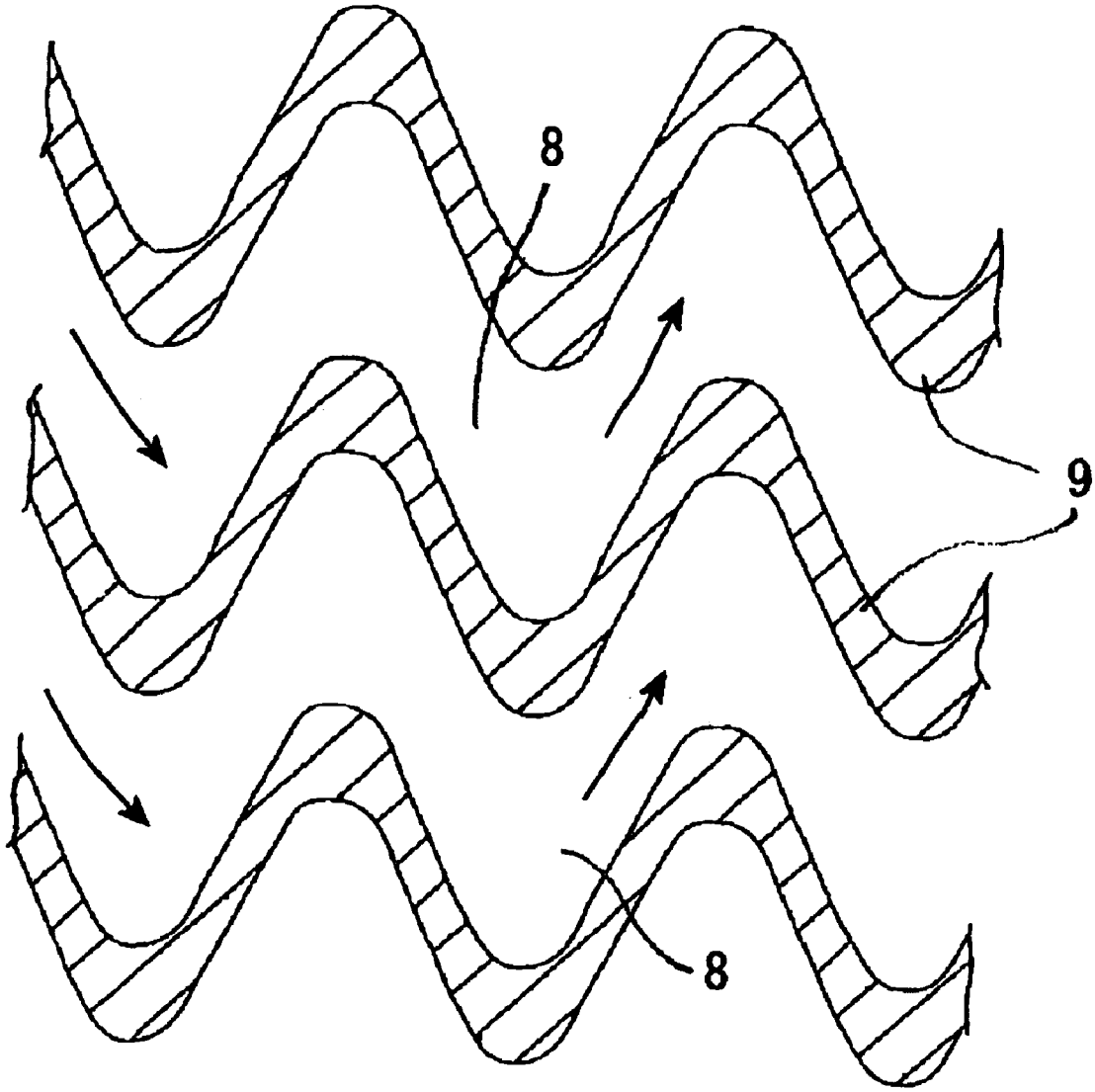
FIG. 9 is a drawing for explaining the shape of heat exchanger fins which are formed by altering the shape of the foregoing heat exchanger fins and which continue from an inlet side to an outlet side in the shape of a pseudo sine curve.

According to the embodiment of the invention, fins, which have a cross-sectional shape whose perimeter is formed by using curves such as pseudo sine curves divided by about one-fourth of a cycle, are used as the heat exchanger fins 9; however, curves divided by about half or about one-third of a cycle may be used. In addition, as shown in FIG. 9, continuous fins, which have a curve formed by using a continuous sine curve, a pseudo sine curve formed by altering the waveform of the continuous sine curve, a curve forming part of a circle, an ellipse, a parabola, a hyperbola, or the like, or a combination of those curves, may be used from the inlet openings to the outlet openings of the heat exchanger.

Figure 11:
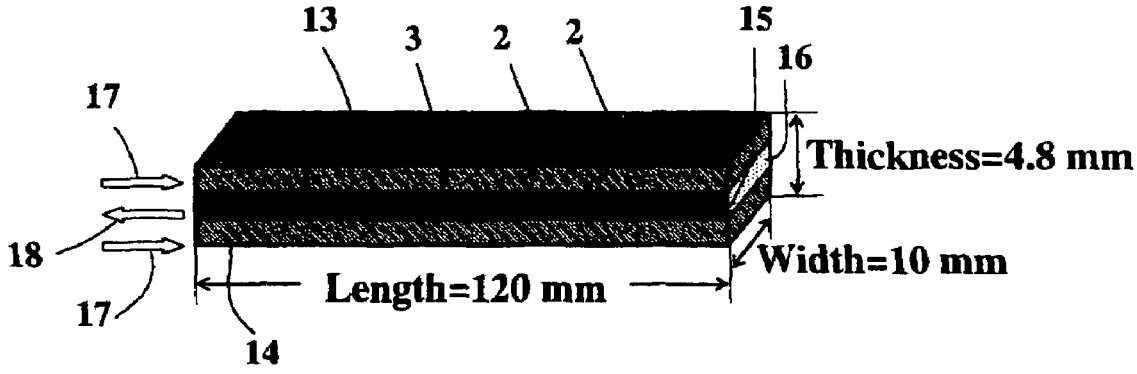
FIG. 11 is a drawing for explaining the system of a comparative experiment on the arrangement of plates, geometric shapes, numerical calculation boundary conditions, and so on included in the comparative conditions of the heat transfer flow performance of the heat exchangers based on the comparative experiment on the performance of the heat exchangers according to the invention and the conventional heat exchangers.
Figure 12:
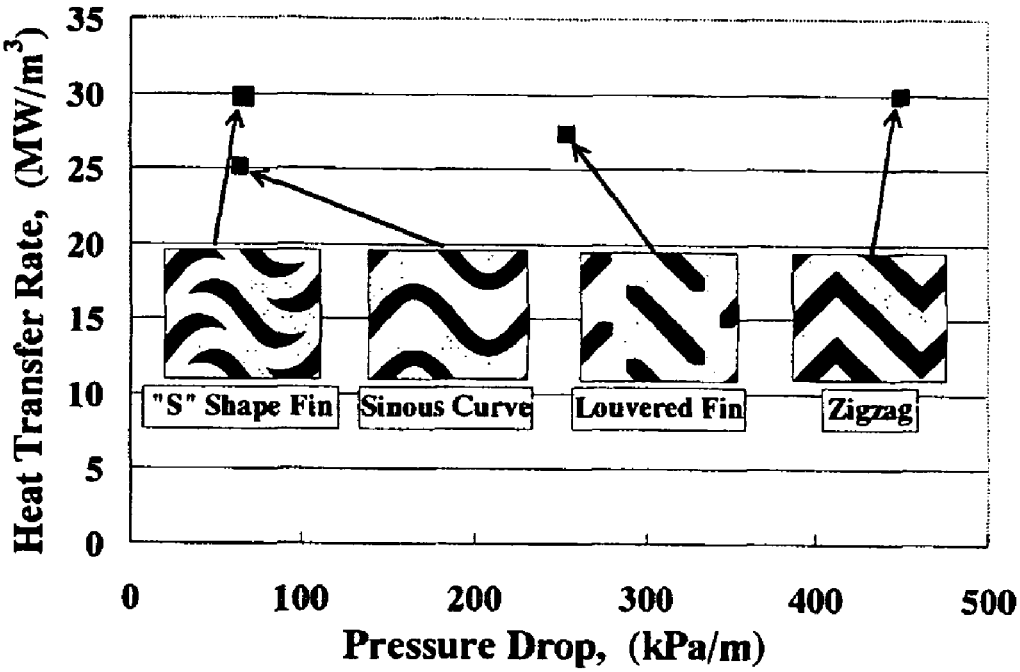
FIG. 12 is a graph for explaining comparative experiment results on the performance of the heat exchangers according to the invention and the conventional heat exchangers which are represented as a relationship between the heat transfer performance per volume and the pressure loss per unit length of the heat exchangers.
Figure 14:
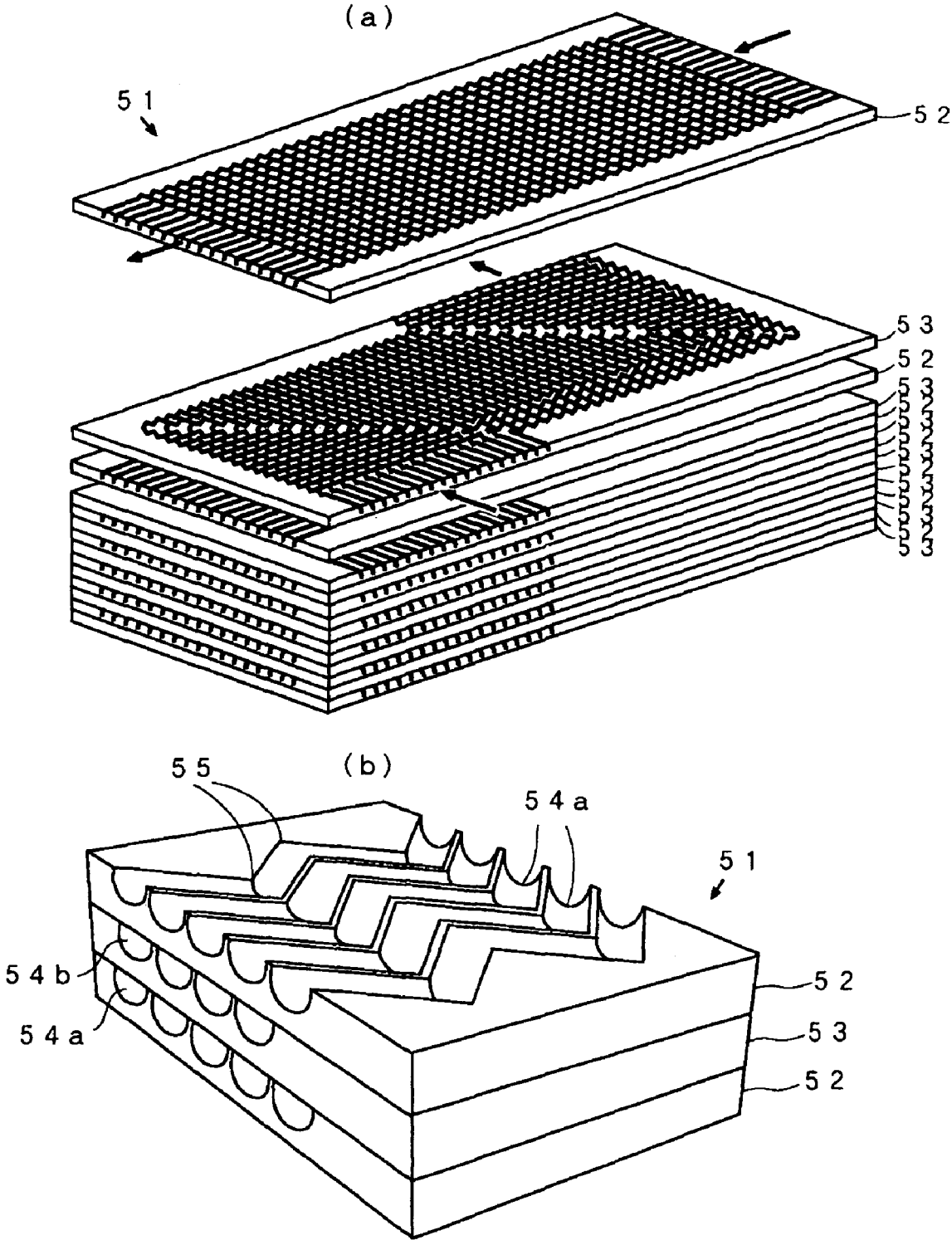
FIG. 14(*a*) is a perspective view for explaining stacked thin metal plates used for a conventional heat exchanger.

The present inventors conducted a comparative experiment on heat exchange performance through the use of conventional fluid channels and the fluid channel according to the invention. That is, a comparative experiment on the heat exchange performance was conducted by using a conventional heat exchanger having a continuous zigzag fluid channel (hereinafter, "conventional type heat exchanger"), a conventional typical plate-fin type heat exchanger whose fluid channel is formed by using discontinuous fins called louvered fins (hereinafter, "louvered fin type heat exchanger"), the heat exchanger according to the embodiment of the invention having the fluid channel formed by using the fin rows including the heat exchanger fins whose perimeter is formed by the substantially S-shaped curve formed by combining the circle, the ellipse, and the straight line based on the sine curve (hereinafter, "S-shaped fin heat exchanger"), and the heat exchanger according to the embodiment of the invention having the continuous sine curve fluid channel (hereinafter, "continuous sine curve fluid channel heat exchanger"). At that time, the comparative experiment was conducted from a supercomputer using a general purpose three-dimensional heat-transfer flow analytic code FLUENT under conditions indicated in FIGS. 10 and 11. FIG. 10 is a table in which the flow conditions of fluids, materials for thin metal plates, data on the fluid channels, and so on are listed. FIG. 11 is a drawing for explaining the system of the comparative experiment. FIG. 12 is a graph for explaining evaluation results of the experiment.

A plate shown in FIG. 11 has a structure in which a plate 3, through which a fluid on a low-temperature (cold) side fluid flows, is sandwiched between plates 2, through which a fluid on a high temperature (hot) side fluid flows, from above and below. The fluid on the high-temperature side 17 flows through the fluid channel of the plate 2 along the direction from right to left and the fluid on the low-temperature side 18 flows through the fluid channel of the plate 3 along the direction from left to right. The comparative experiment was conducted by imposing heat insulation conditions on both the outer surface 13 of the upper plate 2 for the fluid on the high-temperature side and the outer surface 14 of the lower plate 12 for the fluid on the high-temperature side and cyclic boundary conditions on the nearest outer surface 15 and farthest outer surface 16 of the heat exchangers.

The heat-transfer flow performance of the heat exchangers is evaluated through pressure loss associated with pump power and heat-transfer performance associated with downsizing. FIG. 12 is a graph for explaining comparative experiment results on the performance of the conventional heat exchangers and the heat exchangers of the invention which are represented as a relationship between the heat-transfer performance per unit volume and the pressure loss per unit length of the heat exchangers. Such performance comparisons were made with the heat exchanger according to the invention which has the fin rows consisting of substantially S-shaped fins, the conventional heat exchangers with the zigzag fluid channel, the heat exchanger with the continuous sine curve fluid channel described in the embodiment of the invention, and the conventional typical plate-fin type heat exchanger with the louvered fins.

It has been found from these experimental results that the heat exchangers according to the invention have the following effects.

First, as shown in FIG. 12, it has been found that the pressure loss on the S-shaped fin heat exchanger according to the invention is reduced to about one-sixth that on the conventional type heat exchanger and the heat transfer performance of the S-shaped fin heat exchanger is about the same as that of the conventional type heat exchanger. Moreover, the pressure loss on the S-shaped fin heat exchanger according to the invention is reduced to about one-third that on the conventional louvered fin-type heat exchanger and the heat transfer performance thereof is increased by about 10%.

And furthermore, the heat transfer performance of the continuous sine curve fluid channel heat exchanger according to the invention is lowered by about 20% when compared with that of the conventional type heat exchanger but the pressure loss thereof is reduced to about one-sixth.

Moreover, as shown in FIG. 13, in the S-shaped fin heat exchanger according to the invention (FIG. 13(*b*)) having the fluid channel formed by the discontinuous curved fins, the flow velocity of the fluid within the fluid channel is uniform and low when compared with that of the conventional type heat exchanger (FIG. 13(*a*)) having the fluid channel formed by the conventional type zigzag fins. In contrast, in the conventional type heat exchanger, fluid flow channels, where the fluid flows from the bent portions of the fluid channel to the fluid channel walls at high velocity, are formed, but at places other than those channels, the flow velocity of the fluid is low. In addition, it has been found that the pressure loss on the conventional type heat exchanger is about six times higher than that on the heat exchanger according to a invention due to the flow with a partly high flow velocity (the pressure loss is roughly proportional to the square of the flow velocity) in addition to the formation of vortexes and so on at the bent portions.

What is claimed is:

1. A heat exchanger comprising:

a plurality of heat exchanger fins and fluid channels for high-temperature and low-temperature fluids wherein, the plurality of heat exchanger fins are formed on thin metal plates and have a curved cross-sectional shape from one end thereof to the other, formed to a streamline of the fluid and are staggered in the flow direction of the fluid, and the rear ends of the heat exchanger fins of a plurality of fin rows on the upstream sides in the flow direction of the fluid are provided at midpoint places between the adjacent heat exchanger fins of the fin rows on the downstream sides; and the fluid channels are formed between the two adjacent fins of the two opposed thin metal plates by alternately stacking the thin metal plates having the heat exchanger fins and have channel areas which are substantially uniform at any place in the flow direction of the fluids.

2. The heat exchanger according to claim 1 characterized in that the heat exchanger fins are formed so as to have a cross-sectional shape formed in a substantially S-shaped curve.

3. The heat exchanger according to claim 1 characterized in that the heat exchanger fins are formed so as to have a cross-sectional shape formed in a curve which forms part of a circle, an ellipse, a parabola, or a hyperbola, or a combination of those curves.

4. The heat exchangers according to claim 1 characterized in that the heat exchanger fins are formed in a curved cross-sectional shape from the inlet side of the fluid channel to the outlet side, by forming the streamline of the fluid so as to have a curve along the heat exchanger fins.

5. The heat exchangers according to claim 1 characterized in that the heat exchanger fins are formed in a cross-sectional shape in a curve forming part of a circle, an ellipse, a parabola, or a hyperbola, or a combination of those curves, by forming the streamline of the fluid so as to have the curve forming the part of the circle, the ellipse, the parabola, or the hyperbola, or a combination of those curves along the heat exchanger fins.

6. The heat exchanger according to claim 1 characterized in that the heat exchanger fins are formed so as to have a cross-sectional shape which is formed in a sine curve or a pseudo sine curve formed by altering the waveform of the sine curve which continues along the flow direction of the fluid.

7. The heat exchanger according to claim 1 characterized in that the heat exchanger fins are formed so as to have a cross-sectional shape which is formed in a curve forming part of a circle, an ellipse, a parabola, or a hyperbola, or a combination of those curves which continues along the flow direction of the fluid.

8. The heat exchanger according to claim 1 characterized in that the heat exchanger fins, which have a curved cross-sectional shape from the front end thereof to the rear end in the flow direction of the fluid, are applied to the plate fins of a plate-fin type heat exchanger and in that the area of the fluid channel, through which the fluid flows between the two adjacent heat exchanger fins, is made substantially uniform at any place in the flow direction by changing the zigzag cross-sectional shape of the fins into the curved cross-sectional shape.

* * * * *